US007316394B2

(12) United States Patent
Zeltner et al.

(10) Patent No.: US 7,316,394 B2
(45) Date of Patent: Jan. 8, 2008

(54) SHEET FEEDER HAVING A DRIVE FOR THE SYNCHRONIZED FEEDING OF SHEETS TO A SHEET-PROCESSING MACHINE

(75) Inventors: Jürgen Zeltner, Hirschberg (DE); Darko Zimbakov, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 518 days.

(21) Appl. No.: 10/765,586

(22) Filed: Jan. 26, 2004

(65) Prior Publication Data

US 2004/0251615 A1 Dec. 16, 2004

(30) Foreign Application Priority Data

Jan. 24, 2003 (DE) ..... 103 02 757
Sep. 25, 2003 (DE) ..... 103 44 417

(51) Int. Cl.
*B65H 29/54* (2006.01)

(52) U.S. Cl. ..... 271/306; 271/69

(58) Field of Classification Search ..... 271/69, 271/306; 270/58.08, 58.11; 267/151, 152, 267/168; 192/126; 474/109, 900, 110, 148, 474/150

See application file for complete search history.

(56) References Cited

U.S. PATENT DOCUMENTS 3,393,754 A * 7/1968 Hachemeister ..... 173/5
4,791,869 A 12/1988 Furukawa
5,118,091 A * 6/1992 Nagamoto et al. ..... 271/122
5,170,707 A 12/1992 Thoma

FOREIGN PATENT DOCUMENTS

| | | |
|---|---|---|
| CH | 369 475 | 7/1963 |
| DE | 40 28 756 C1 | 3/1992 |
| DE | 100 40 070 A1 | 2/2002 |

OTHER PUBLICATIONS

Translation of claims and description of German Publication No. DE10040070 from an EPO website http://www.worldlingo.com/wl/epo/epo.html?LOCALE=en_GB&OPS=ops.espacenet.com . . . .*

* cited by examiner

*Primary Examiner*—Patrick Mackey
*Assistant Examiner*—Thomas Morrison
(74) *Attorney, Agent, or Firm*—Laurence A. Greenberg; Werner H. Stemer; Ralph E. Locher

(57) ABSTRACT

In a sheet feeder for a sheet processing machine, such as a sheet-fed rotary printing press, and initial torque spike when the sheet feeder is first switched into the system is reduced with a switch-on torque limiter. The torque limiter is disposed in the drive train between the sheet processing machine and the sheet feeder, so that a torque surge which occurs when the sheet feeder is coupled in at an increased basic speed of the sheet processing machine can be absorbed.

9 Claims, 5 Drawing Sheets

SHEET FEEDER HAVING A DRIVE FOR THE SYNCHRONIZED FEEDING OF SHEETS TO A SHEET-PROCESSING MACHINE

BACKGROUND OF THE INVENTION

Field of the Invention

The invention lies in the field of sheet-processing machines. More specifically, the invention relates to a sheet feeder for a sheet-processing machine, such as a sheet-fed printing press.

In sheet feeders having a clutch for the drive connection to the sheet processing machine, such as a printing press, there exists the problem that the sheet feeder is not usually connected until the printing press has a very high operating speed. A joltlike drive torque caused by the coupling process firstly stresses the drive means with a torque surge and leads to heavy wear of the drive, as well as of driven components and the driving components.

To solve the above-described problem, German published patent application DE 100 40 070 A1 discloses a switchable sheet feeder which, in addition to the actual feeder clutch, has an additional torsionally elastic clutch that diminishes the coupling surge. In order to suppress oscillations between the machine and the feeder in operation, the torsionally elastic clutch is bypassed via a further, torsionally rigid clutch after the coupling process.

A clutch configuration of that type, however, is complicated in construction terms and it is relatively expensive.

SUMMARY OF THE INVENTION

It is accordingly an object of the invention to provide a sheet feeder for a sheet-processing machine which overcomes the above-mentioned disadvantages of the heretofore-known devices and methods of this general type and which provides for a sheet feeder that can be coupled in and has a device for absorbing the torque surges caused by the coupling process.

With the foregoing and other objects in view there is provided, in accordance with the invention, a sheet feeder for the synchronized feeding of sheets to a sheet processing machine having a machine drive, the sheet feeder comprising:

drive assemblies for driving the sheet feeder and a drive train connecting the drive assemblies to the machine drive of the sheet processing machine;

a clutch selectively switchable with a determined angular position into the drive train between the drive assembly of the sheet feeder and the machine drive of the sheet processing machine; and a switch-on torque limiter with a pretensioned spring element connected in the drive train.

Arranging a switch-on torque limiter according to the invention in the drive train of the feeder leads to a reduction of the torque surge when coupling the feeder to the rotating machine, for example sheet processing machine, in particular printing press, while ensuring the correct phase relation between the latter in operation and reducing oscillations between the feeder and machine.

In one advantageous refinement, a pretensioned elastic element is incorporated into the drive train, which becomes active after a threshold load is exceeded (for example during the coupling process) and limits the torque surge.

This threshold load is higher than the torques to be transmitted during feeder operation, so that the elastic element is not effectively loaded and the feeder is rigidly coupled to the machine.

In one advantageous development of the subject matter of the invention, it is possible to integrate the switch-on torque limiter into a phase adjusting mechanism.

In accordance with an added feature of the invention, the switch-on torque limiter is disposed between the machine drive of the sheet processing machine and the clutch. Alternatively, the switch-on torque limiter is disposed between the clutch and the drive assemblies of the sheet feeder.

In accordance with a specific embodiment of the invention, the switch-on torque limiter includes four stationary and symmetrically disposed deflection rollers and two displaceable deflection rollers.

Furthermore, there may be provided an endless belt that is part-way wrapped around each of the deflection rollers (the four stationary deflection rollers and the two displaceable deflection rollers).

In accordance with another feature of the invention, there is provided a carriage that supports the displaceable deflection rollers, and a second spring element holding the carriage in a pretensioned state in an operating position.

In accordance with again a further feature of the invention, the first above-mentioned pretensioned spring element configured to absorb a torque surge introduced when the machine drive is first connected to the drive assemblies of the sheet feeder, and a second spring element is configured to cushion a recoil movement of the switch-on torque limiter.

In accordance with a preferred embodiment of the invention, the first spring element and the second spring element are disposed coaxially inside one another.

In accordance with a concomitant feature of the invention, an actuating motor is operatively associated with the carriage for adjusting the carriage specifically to adjust a phase between the machine drive and the drive assemblies of the sheet feeder. Specifically, the actuating motor is operatively associated with the carriage for adjusting a phase between a pinion of the machine drive and a pulley wheel in the drive train.

Other features which are considered as characteristic for the invention are set forth in the appended claims.

Although the invention is illustrated and described herein as embodied in a sheet feeder having a drive for the synchronized feeding of sheets to a sheet processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
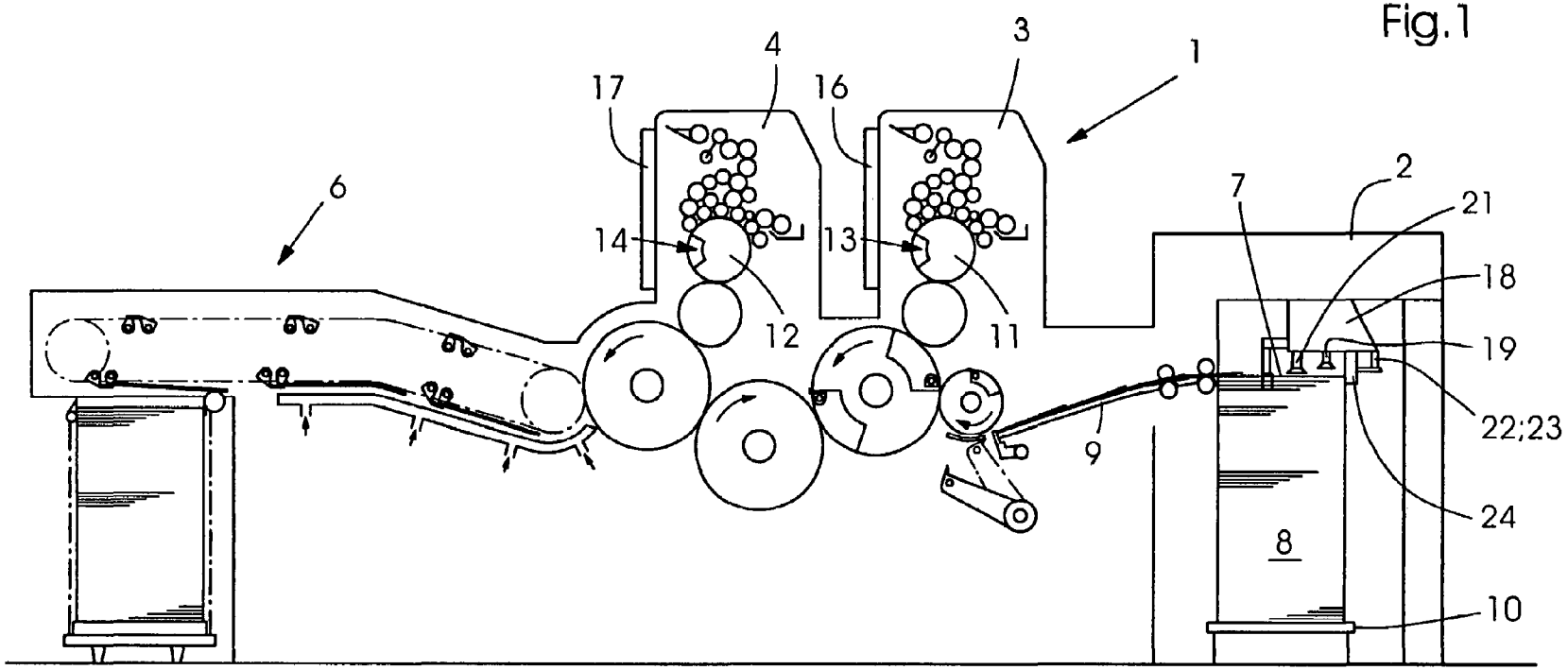
FIG. 1 is a diagrammatic representation of a section taken through a sheet-fed rotary printing press.
Figure 2:
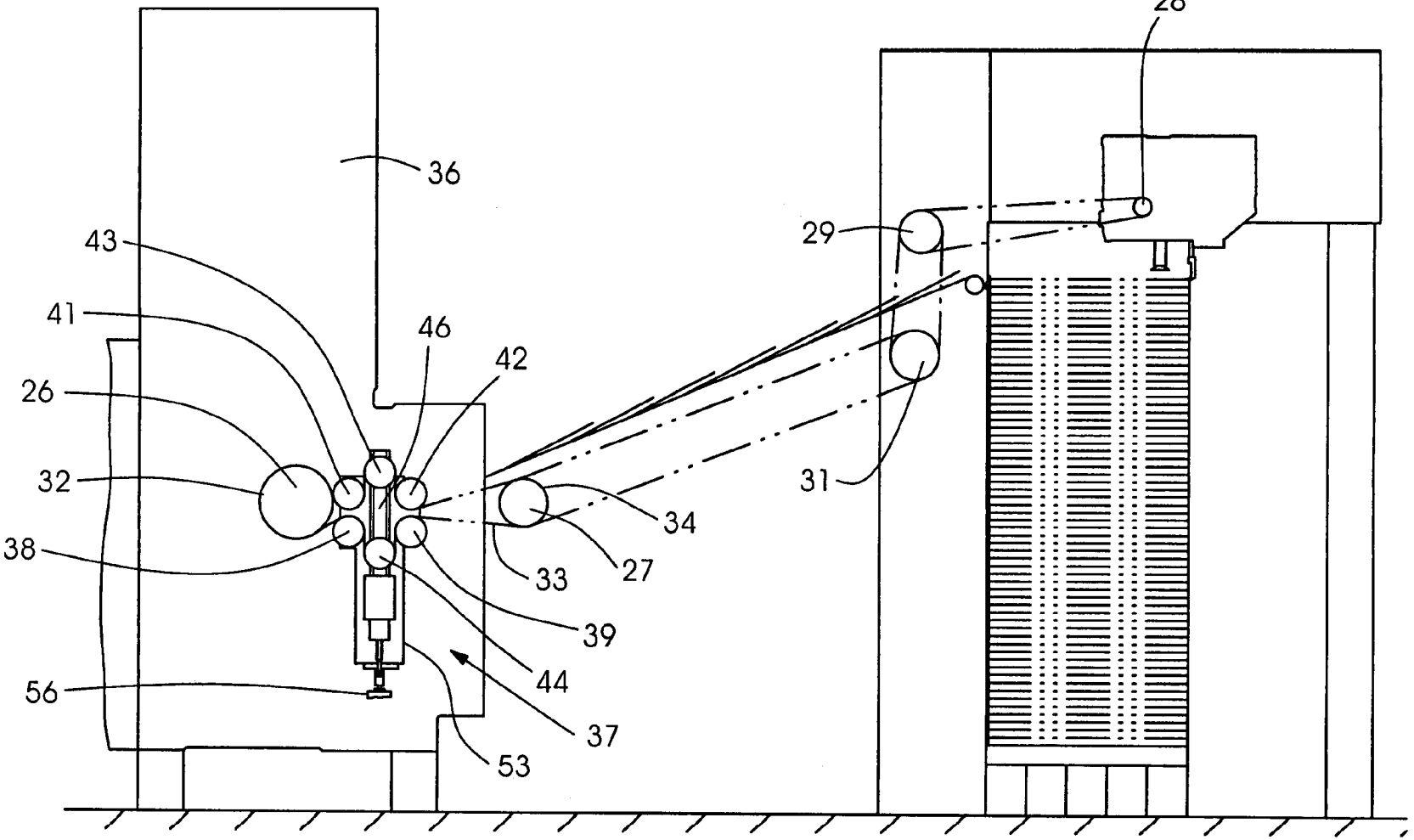
FIG. 2 is a diagrammatic representation of a section through a drive for the feeder of the sheet-fed rotary printing press.

Referring now to the figures of the drawing in detail and first, particularly, to FIG. 1 thereof, there is shown a rotary press, e.g. a printing press 1 which processes sheets 7, has a feeder 2, at least one printing unit 3 or 4 and a delivery 6. The sheets 7 are taken from a stack of sheets 8, a sheet pile 8, and, separated or overlapped, are fed over a feed table 9 to the printing units 3 and 4. Each of the printing units 3, 4 contains a respective plate cylinder 11, 12. The plate cylinders 11 and 12 each have a device 13, 14 for fastening flexible printing plates. Furthermore, each plate cylinder 11, 12 is assigned a device 16, 17 for semiautomatic or fully automatic printing plate change.

The sheet feeder 2 is driven from a drive shaft 26 of the machine drive. A switchable clutch 27 connects the drive of the sheet-processing machine 1 to the drive assemblies of the sheet feeder 2, for example the drive 28 for the suction head mechanism and air control means; a drive 29 for the intermittently operated roller and flap shaft; and a drive 31 for the transport belt. The clutch 27 is switchable at a determined angular position of the clutch 27. The drive shaft 26 is provided with a pinion 32 for an endless belt 33. The belt 33 wraps around a pulley wheel 34 of the clutch 27.

Figure 3:
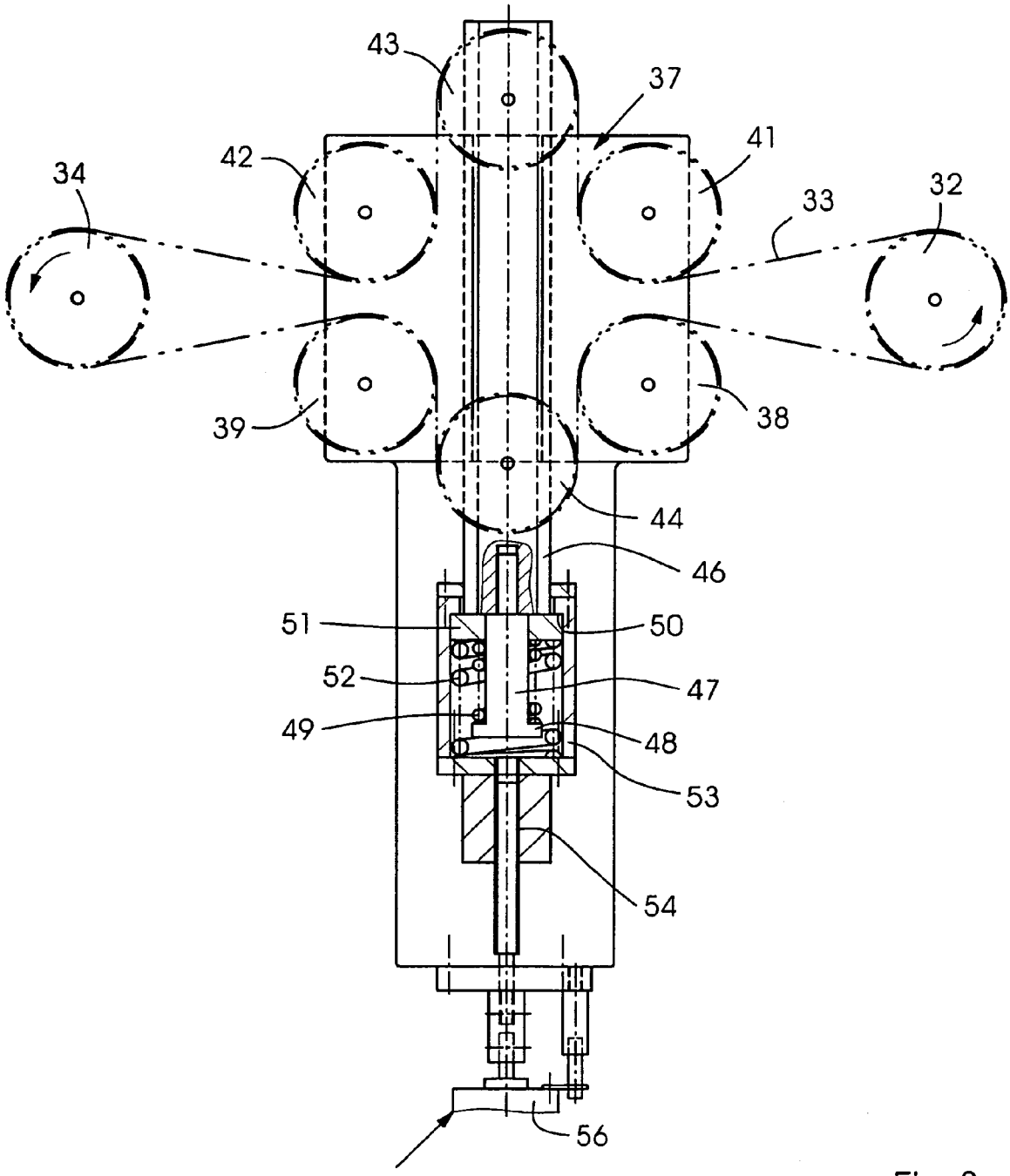
FIG. 3 is a diagrammatic view of the switch-on torque limiter according to the invention in the switched operating state of the feeder.

A device for absorbing a torque surge of the belt 33 is disposed on a side frame 36. The device will be referred to as a "switch-on torque limiter 37" in the following text. It substantially comprises four stationary deflection rollers 38, 39, 41, 42 that are symmetrically arranged and two further, non-stationary deflection rollers 43, 44. It will be understood that the term "stationary" refers to the respective axes of the rollers only. The rollers are rotatably supported. The rollers 43, 44 can be displaced together. The rollers 43, 44 are disposed on a displaceable carriage 46. The belt 33 is wrapped around all the deflection rollers 38, 39, 41, 42, 43, 44. In the drive direction shown in FIGS. 3 to 5 (counter-clockwise), the deflection roller 44 is disposed in the region of the load run and the deflection roller 43 is disposed in the region of the empty run.

At its end adjacent to the deflection roller 44, the carriage 46 has a guide 47 with a stop 48 for a first spring element 49. The spring element 49 is configured as a helical spring, and one end of it is supported on the stop 48 and the other end is supported on a plate 51 which can be displaced along the guide 47. As the spring element 49 is installed in a pretensioned state (approximately 2 to 3 times the operating moment), it pushes the plate 51 against a stop 50 of a housing 53. A second spring element 52 encloses the spring element 49, and one end of the former is likewise supported on the plate 51 and the second end is supported on the housing 53 which encloses the spring elements 49, 52, the plate 51 and the guide 47. The second spring element 52 is also constantly in a pretensioned state. When the sheet feeder 2 or its stationary drive assemblies are coupled to the sheet processing machine 1 which is already rotating at a rotational speed, the result is a not inconsiderable torque surge which acts on the belt 33. The load is applied here to the load run. This tension leads to the deflection roller 44 being deflected upward in the direction of the arrow in FIG. 4. Together with the carriage 46 and the deflection roller 43, said deflection occurs counter to the force of the first spring 49. As a result of this measure, the torque surge is absorbed by the spring deflection when the sheet feeder 2 is coupled in, that is to say it is limited to an amount which corresponds to the spring force.

Figure 4:
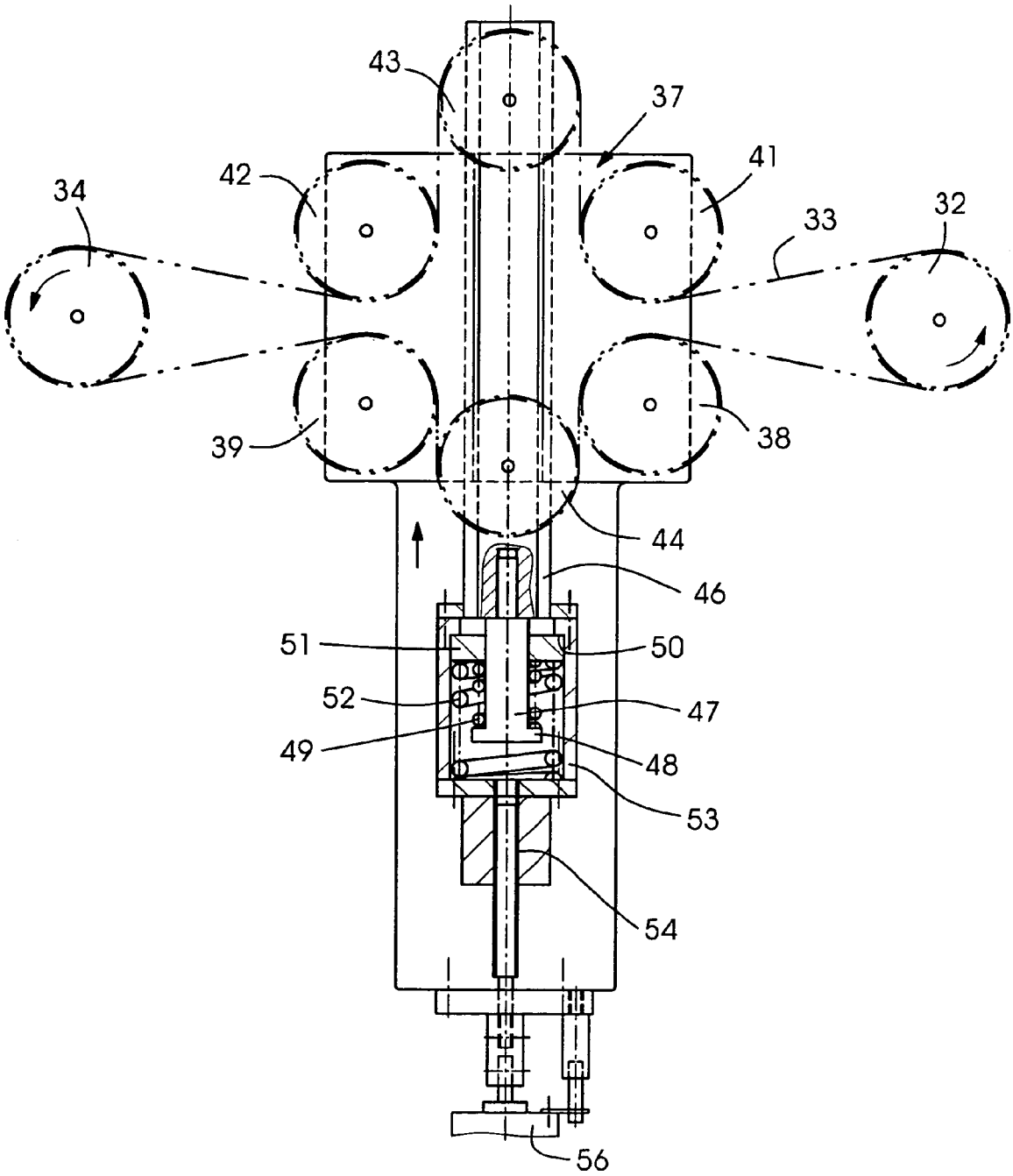
FIG. 4 is a similar view of the switch-on torque limiter during absorption of the switch-on torque surge.
Figure 5:
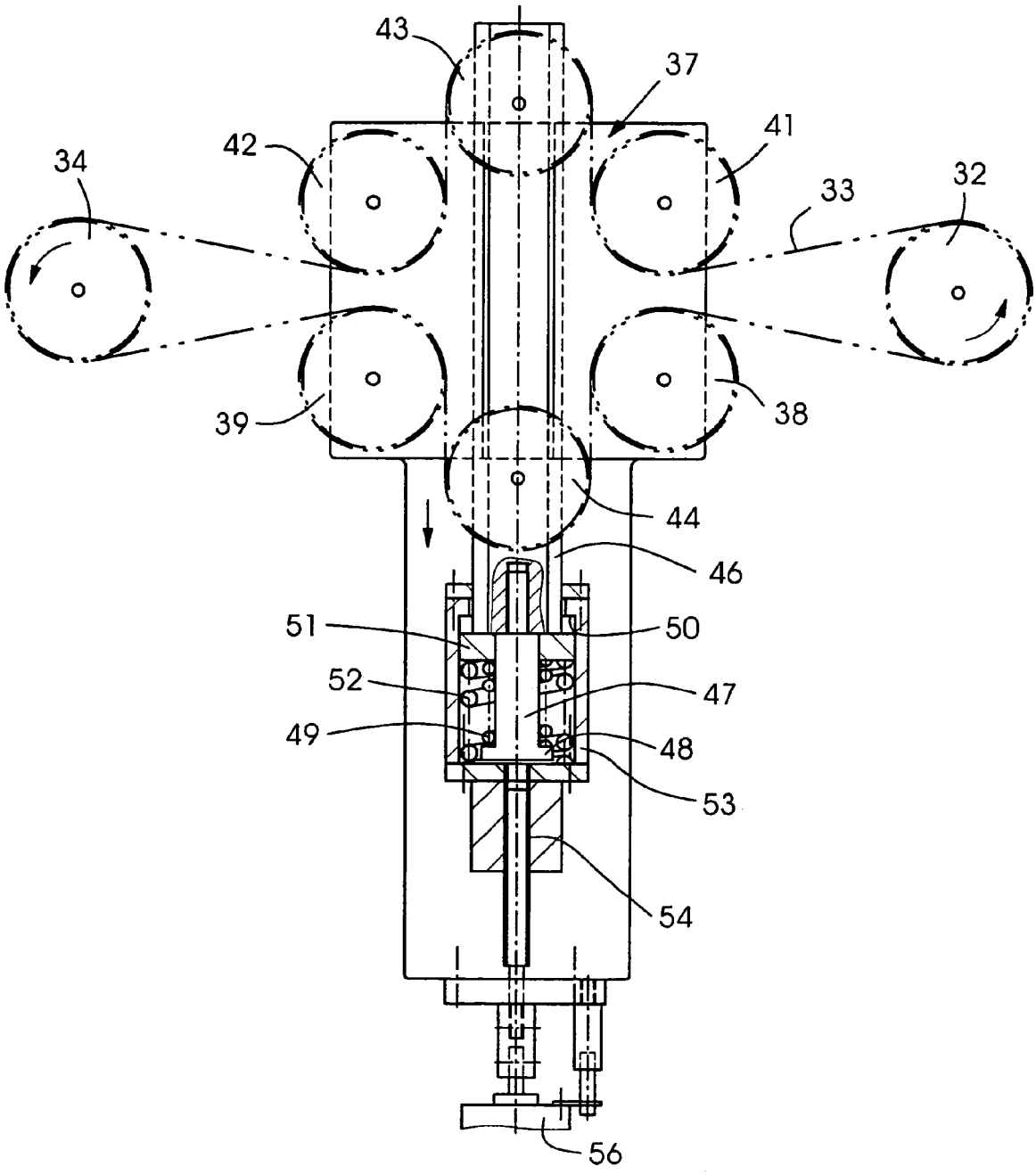
FIG. 5 is a similar view of the switch-on torque limiter during the cushioning of the recoil movement.

FIG. 4 shows the carriage 46 extended upward counter to the force of the first spring element 49. The carriage 46 is pressed back into the operating position by the action of the first spring element 49. Here, as shown in FIG. 5, the carriage 46 swings beyond the operating position, to be precise in such a manner that the second spring element 52 is now compressed, while the first spring element 49 is relieved to its original pretensioned state. The carriage can thus oscillate back and forth a number of times, depending on the magnitude of the coupling torque. After a short time, the switch-on torque limiter 37 is again situated in its stationary initial position, the operating position. Here, the pretensioned spring elements 49, 52 are designed to be so stiff that operational torques cannot lead to a deflecting movement of the carriage 46.

In the preferred exemplary embodiment, the switch-on torque limiter 37 is also simultaneously used as a phase adjusting mechanism. There is provision here for the housing 53 to be provided with an actuating motor 56 via a gear mechanism 54, for example a threaded rod and hole. The actuating movement is transmitted to the carriage 46 via the stiffly designed second spring element 52 and therefore ensures specific deflection of the load run and empty run which results in phase adjustment of the drive pinion 32 with respect to the pulley wheel 34.

We claim:

1. A sheet feeder for the synchronized feeding of sheets to a sheet processing machine having a machine drive, the sheet feeder comprising:

drive assemblies for driving the sheet feeder and a drive train connecting said drive assemblies to the machine drive of the sheet processing machine;

a clutch selectively switchable at a determined angular position thereof into said drive train between said drive assemblies of the sheet feeder and the machine drive of the sheet processing machine; and a switch-on torque limiter being a pretensioned spring element connected in said drive train, said switch-on torque limiter including four stationary and symmetrically disposed deflection rollers and two displaceable deflection rollers, and said switch-on torque limiter configured to activate upon a switching of said clutch into said drive train.

2. The sheet feeder according to claim 1, wherein said switch-on torque limiter is disposed between the machine drive of the sheet processing machine and said clutch.

3. The sheet feeder according to claim 1, wherein said switch-on torque limiter is disposed between said clutch and said drive assemblies of the sheet feeder.

4. The sheet feeder according to claim 1, wherein said switch-on torque limiter includes an endless belt partly wrapped around said four stationary deflection rollers and around said two displaceable deflection rollers.

5. The sheet feeder according to claim 1, wherein said switch-on torque limiter includes a carriage carrying said displaceable deflection rollers, and a second spring element holding said carriage in a pretensioned state in an operating position.

6. The sheet feeder according to claim 1, wherein said pretensioned spring element is a first spring element configured to absorb a torque surge introduced when the machine drive is first connected to said drive assemblies of the sheet feeder, and a second spring element is configured to cushion a recoil movement of said switch-on torque limiter.

7. The sheet feeder according to claim 6, wherein said first spring element and said second spring element are disposed coaxially with said first spring element disposed inside said second spring element.

8. The sheet feeder according to claim 5, which comprises an actuating motor operatively associated with said carriage for adjusting said carriage specifically to adjust a phase between the machine drive and said drive assemblies of the sheet feeder.

9. The sheet feeder according to claim 8, wherein the machine drive includes a pinion and said drive train includes a pulley wheel, and wherein said actuating motor adjusts a phase between said pinion and said pulley wheel.

* * * * *